US006620019B1

(12) United States Patent
Kuo

(10) Patent No.: US 6,620,019 B1
(45) Date of Patent: Sep. 16, 2003

(54) MAGIC EGG

(76) Inventor: Wen-Chuan Kuo, 8F., No. 92, Sunggau Rd., Shinyi Chiu, Taipei (TW)

( * ) Notice: Subject to any disclaimer, the term of this patent is extended or adjusted under 35 U.S.C. 154(b) by 0 days.

(21) Appl. No.: 10/254,596

(22) Filed: Sep. 26, 2002

(51) Int. Cl.[7] ..... A63H 33/00
(52) U.S. Cl. ..... 446/71; 446/76; 446/385
(58) Field of Search ..... 446/71, 76, 267, 446/385, 491; 473/577, 594, 574; 472/51–53

(56) References Cited

U.S. PATENT DOCUMENTS 3,091,053 A * 5/1963 Growald ..... 446/14
3,195,267 A * 7/1965 Gehlen ..... 446/168
3,712,627 A * 1/1973 Stroud ..... 473/595
5,413,332 A * 5/1995 Montgomery ..... 473/570

* cited by examiner

*Primary Examiner*—Derris H. Banks
*Assistant Examiner*—Bena B. Miller
(74) *Attorney, Agent, or Firm*—Rosenberg, Klein & Lee

(57) ABSTRACT

The present invention relates to a magic egg, which mainly comprises a hollow egg-like membrane having the color of egg white, and features of contractibility and stickiness, and besides, an opening is set at the top portion to let the diaphanous liquid and the yellow ball pass through and enter the egg-like membrane to bulge it, making it like an elliptic egg. In addition, a cover is combined with the opening of the egg-like membrane to enclose the opening steadily so that the diaphanous liquid can be prevented from effusion. When the user exert himself to cast the egg-like membrane having the diaphanous liquid and the yellow ball toward an plane, the egg-like membrane can adhere to the plane in a flat status like a fried egg. After a period, the egg-like membrane slowly recovers to the original elliptic egg style because of its contractibility.

4 Claims, 5 Drawing Sheets

MAGIC EGG

BACKGROUND OF THE INVENTION

1. FIELD OF THE INVENTION

The present invention relates to a magic egg, especially for a new one of which an appearance is like an elliptic egg in normal occasion and is as flat as a fried egg when it is thrown at a plane. After a period, the flat style can recover the shape to egg-like ellipsoid. Therefore, the current invention called a magic egg is useful for people to have fin with.

2. DESCRIPTION OF THE PRIOR ART

General rubber toys come in various shapes and types. The manufacturer can shape rubber toys into any wanted style to make people have fresh feeling in sight. Besides, the user can change the shape by pulling and kneading because rubber has good toughness. Change and recovery of the shape due to contractibility of rubber make people can play the toy repeatedly without damage. However, general rubber toys usually vary in model, and really have no new fashion. For increasing interest, rubber toys having stickiness have invented. The user can throw the toy having various models ahead, and the toy can adhere to the destination to add fun. Although the rubber toys have stickiness and contractibility, the general products are shaped mainly in flat styles. If the rubber toys can be shaped in three-dimension, and the models can change to another special styles when they adhere to a plane after thrown at the plane, the value of joy can be increased. For example, after thrown at a plane, an egg-like toy adheres to the plane and the model can change to a style like a fried egg.

From what described above, commonly used objects described above still have many disadvantages and are not perfect designs such that improvement is required.

The inventor of the current invention worked hard for improving the disadvantages resulted from the disadvantages of objects described above and for invention. After several years of hard work, the current invention, two-part uniform pressure core mold, is finally finished.

SUMMARY OF THE INVENTION

The first purpose of the present invention is to provide a fresh and interesting magic egg having an elliptically egg-like membrane which becomes flat in appearance, as a fried egg, after it is thrown at a plane, and recovers to normal shape after a period of time.

The second purpose of the present invention is to provide a magic toy, which is a new toy allowing a user to play with repeatedly and having more additional value.

The third purpose of the present invention is to provide a magic egg which isn't easy to be damaged and is easy to be manufactured, and the cost is low.

The magic egg achieving the above-described purposes comprises a hollow egg-like membrane, a cover, a diaphanous liquid and a yellow ball; the egg-like membrane has egg white color, contractibility, and stickiness; an opening is set at the top portion; the diaphanous liquid and the yellow ball pass through the opening and enter the egg-like membrane to bulge it, making it like an elliptic egg. The yellow ball is placed inside the egg-like membrane, like the egg yoke, and it makes the cover to combine with the opening of the egg-like membrane to enclose the opening steadily so that the diaphanous liquid can be prevented from effusion. When the user exert himself to cast the egg-like membrane toward a plane, the egg-like membrane can adhere to the plane because of it's stickiness. Meanwhile, the diaphanous liquid therein spread around due to strike so that egg-like membrane adhere to the plane in a flat status. At this moment, the yellow ball is protruded such that the egg-like membrane at the plane is like fried egg. After a period of time, the egg-like membrane slowly recover to the original elliptic egg style because of it's contractibility. A new funny toy which can be repeatedly played can be performed in the foregoing way.

BRIEF DESCRIPTION OF THE DRAWINGS

The drawings disclose an illustrative embodiment of the present invention which serves to exemplify the various advantages and objects hereof, and are as follows.

FIGURE REMARK

1 Egg-like memrane
11 Opening
2 Diaphanous liquid
3 Yellow ball
4 Cover
41 Body
42 Column
5 plane

DETAILED DESCRIPTION OF THE PREFERRED EMBODIMENT

Figure 1:
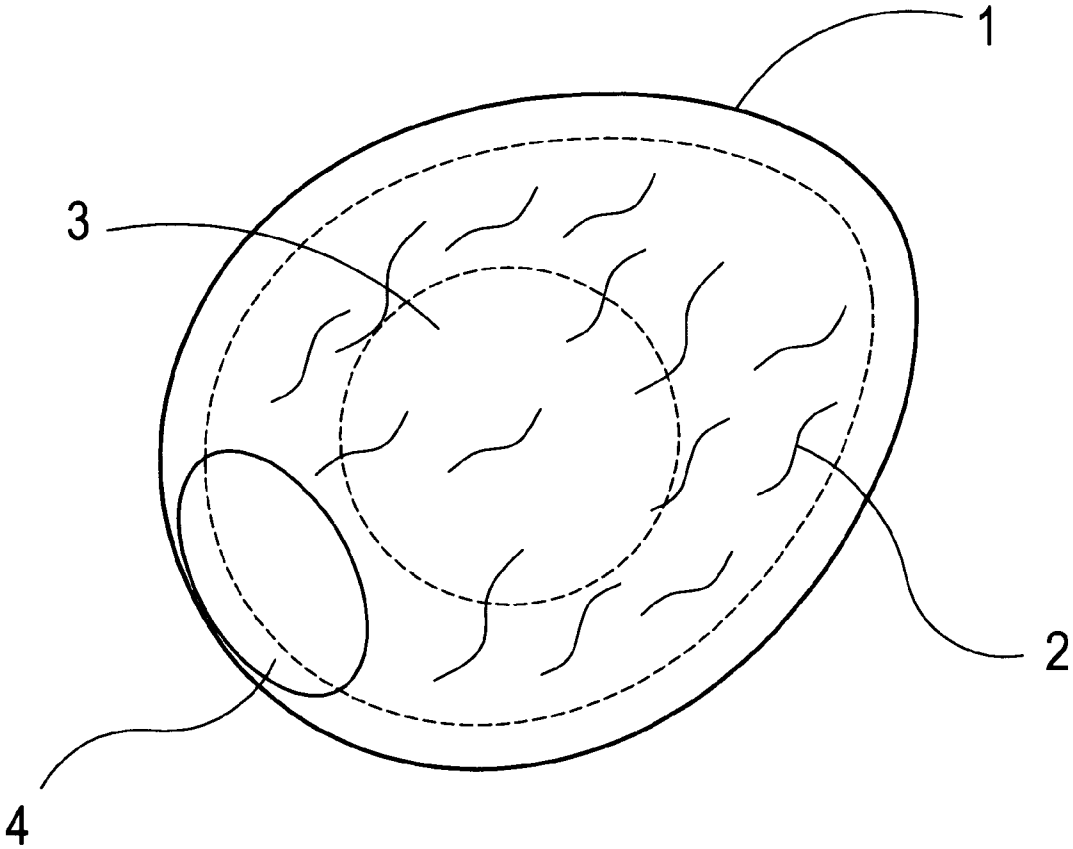
FIG. 1 is the 3D schematic diagram of the present invention, a magic egg.
Figure 2:
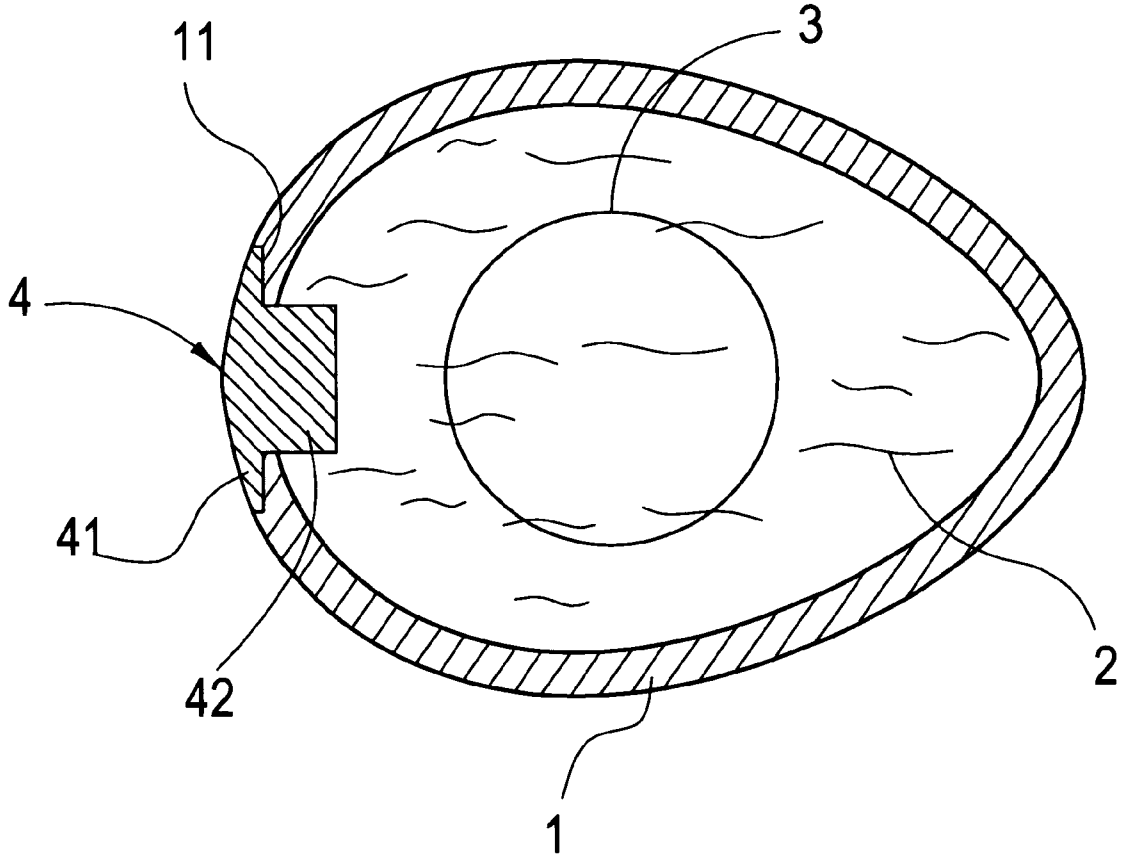
FIG. 2 is the sectional diagram of the present invention, a magic egg.

Referring to FIG. 1 and FIG. 2 which illustrate the present invention, the magic egg mainly comprises:

- an egg-like membrane 1, which is hollow and the color thereof is the same with egg white, and also has contractibility, and stickiness; a ladder-like opening 11 being set at the top portion; the opening being able to be set at any portion of the egg-like membrane without restriction; the egg-like membrane being able to be made of thermoplastic rubber (man-made rubber);
- a diaphanous liquid 2, which enters the egg-like membrane 1 via the opening 11 at the top portion of the egg-like membrane 1, to bulge it, making it like an elliptic egg.
- a yellow ball 3, which enters the egg-like membrane 1 via the opening 11 at the top portion of the egg-like membrane 1 to float in the diaphanous liquid, as the egg yoke drift in the egg-like membrane;
- a cover 4, which includes a body 41 and a column 42 extended from the central portion of the body 41 and thus the sectional shape of the cover 4 is formed in T-type; the material of the cover 4 is the same with the egg-like membrane, both able to be made of thermoplastic rubber (artificial rubber);

The cover 4 is combined with the opening 11 of the egg-like membrane 1 such that the column 42 of the cover 4 enters into the egg-like membrane 1 via the opening 1 and the body 41 encloses the opening 11 tightly. In this way, the diaphanous liquid 2 can be prevented from effusion. The present invention, the magic egg, is performed.

Figure 3:
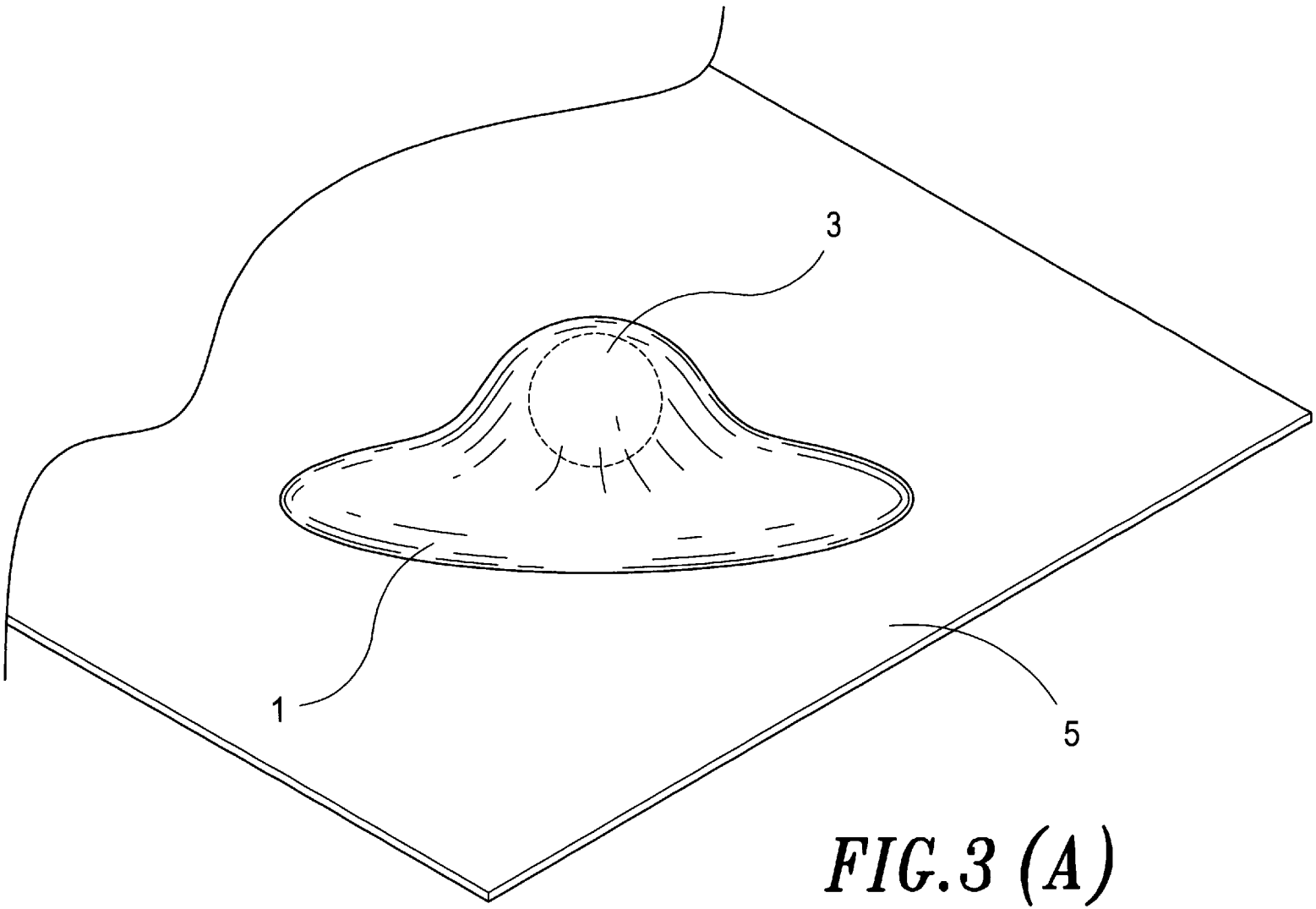
FIGS. 3 A,B,C,D are the schematic diagram of the present invention, a magic egg, in practice
Figure 3:
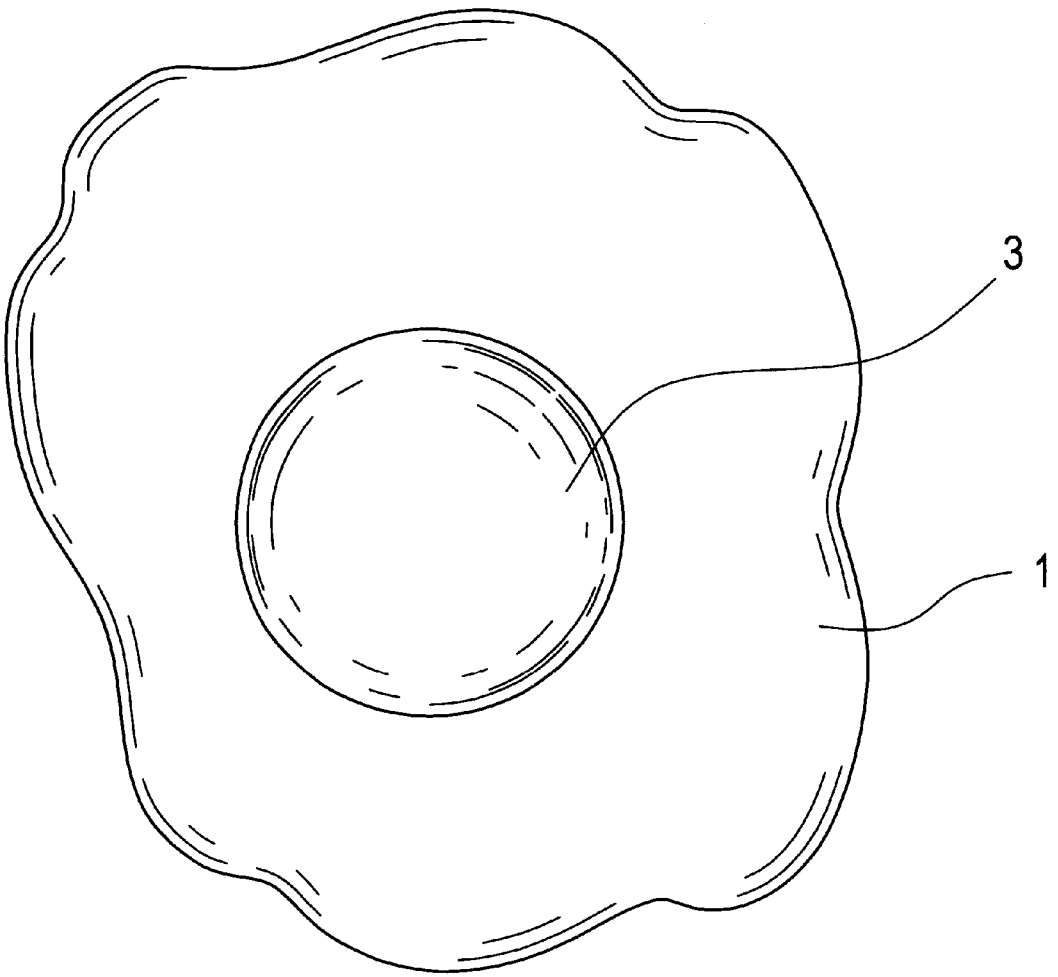
Figure 3D:
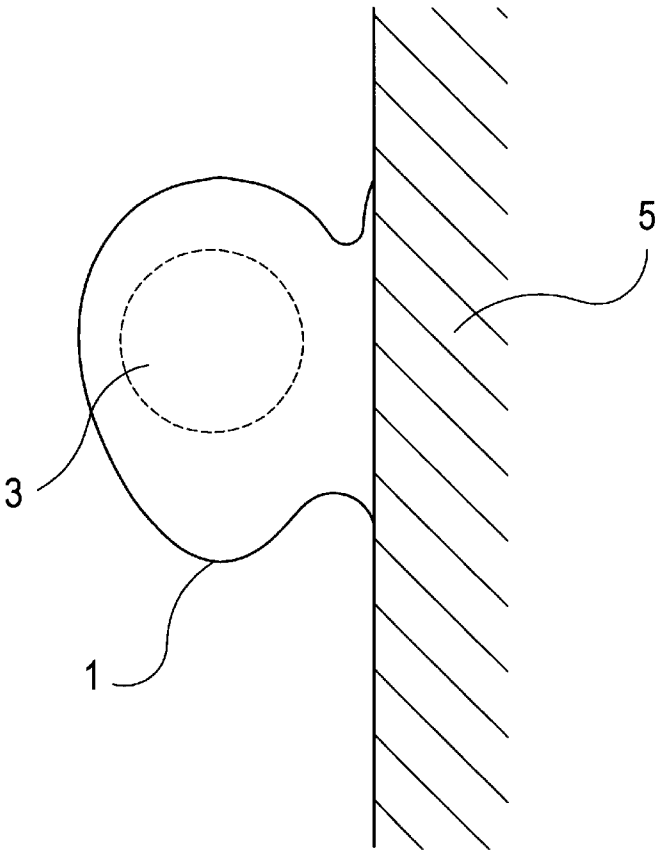
Figure 3C:
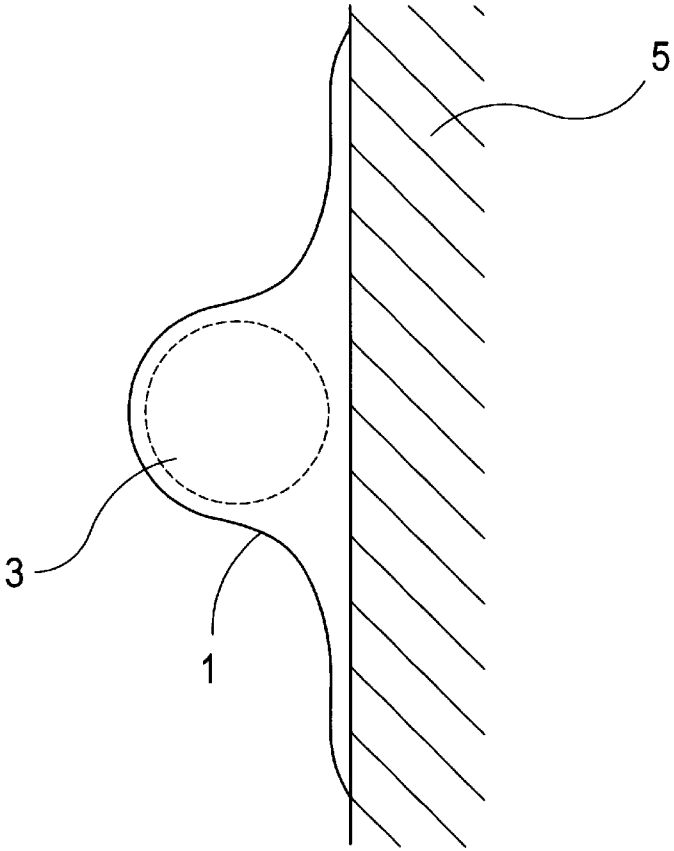

Referring to FIGS. 3 A, B, C, D which are the schematic diagrams of the present invention, the magic egg, in practice, when the user exerts himself to cast the egg-like membrane

1 toward an plane 5, the egg-like membrane 1 can adhere to the plane 5 because of its stickiness. Meanwhile, the diaphanous liquid 2 therein spread around due to strike with making the egg-like membrane 1 also spread so that egg-like membrane 1 adhere to the plane 5 in a flat status. At this moment, the yellow ball 3 is protruded such that the egg-like membrane 1 at the plane 5 is like a fried egg. After a period of time, the egg-like membrane 1 slowly recover to the original elliptic egg style because of its contractibility such that the user can cast it again. Besides, the egg-like membrane 1 is full of the diaphanous liquid 2 such that the egg-like membrane is very soft and thus the shape thereof can be changed. The user can grip and the egg-like membrane 1 and knead it willfully such that the yellow ball 3, as the egg yoke, can protrude the fingers of the user to get another kind of fun.

Comparing with other commonly used technologies, the magic egg provided from the present invention has the following advantages:

1. The present invention makes the egg-like membrane able to be thrown toward a plane to make the elliptic egg-like membrane to adhere to the plane, like a fried egg. After a period of time, the shape of the egg-like membrane can recover to its original elliptic egg-like shape due to its contractibility so that the user can throw the egg-like membrane again.
2. The present invention makes the egg-like membrane able to be grasped inside the palm of the user and thus be kneaded such that the egg yolk-like yellow ball can protrude the fingers. Therefore, the user can have different fin.
3. The egg-like membrane of the present invention is full of the diaphanous liquid and thus is very soft such that the shape can vary at the user's will. The user can play the present invention in methods of throwing, pulling, and kneading, etc.

What is claimed is:

1. A novelty egg toy comprising:

a hollow shell having a substantially ovoid contour and being formed of an elastic membrane, said hollow shell having an opening formed therethrough, said hollow shell receiving a translucent fluid;

a yellow ball received within said hollow shell; and, a cover member having a base and a column member projecting therefrom, said column member being received by said opening to seal said translucent fluid and said yellow ball within said hollow shell.

2. The novelty egg toy as recited in claim 1 wherein said elastic membrane is formed of a material having an egg-white color.

3. The novelty egg toy as recited in claim 1 wherein said elastic membrane is formed from thermoplastic rubber.

4. The novelty egg toy as recited in claim 1 wherein said cover member is formed from a thermoplastic rubber material.

* * * * *